US007235753B1

(12) United States Patent
Forest

(10) Patent No.: US 7,235,753 B1
(45) Date of Patent: Jun. 26, 2007

(54) EXTEND A SWITCH

(76) Inventor: Gerard Forest, 711 San Salvador Cove, Port St. Lucie, FL (US) 34986

( * ) Notice: Subject to any disclaimer, the term of this patent is extended or adjusted under 35 U.S.C. 154(b) by 92 days.

(21) Appl. No.: 11/089,711

(22) Filed: Mar. 25, 2005

Related U.S. Application Data

(60) Provisional application No. 60/556,943, filed on Mar. 25, 2004.

(51) Int. Cl.
*H01H 17/00* (2006.01)
*H01H 3/20* (2006.01)

(52) U.S. Cl. ..... 200/331; 200/330; 200/338

(58) Field of Classification Search ..... 200/331
See application file for complete search history.

(56) References Cited

U.S. PATENT DOCUMENTS 2,668,456 A * 2/1954 Meistrell ..... 74/503
4,295,026 A 10/1981 Williams et al.
4,454,401 A * 6/1984 Powis, Jr. ..... 200/331
4,705,924 A * 11/1987 Hevoyan ..... 200/331
5,347,797 A * 9/1994 Seal et al. ..... 54/46.1
5,374,797 A * 12/1994 McMillan ..... 200/331
6,036,330 A * 3/2000 Sanguedolce ..... 362/95

* cited by examiner

*Primary Examiner*—Elvin Enad
*Assistant Examiner*—Lheiren Mae A. Anglo

(57) ABSTRACT

A light switch and wall plate combination for use within a building or residence. The light switch is a standard light switch, but is connected to a slide bar that is placed in between a wall surface and an extended wall plate. The wall plate has two holes, one of which through the light switch can be accessed. The slide bar can be accessed through the other hole on the wall plate. An individual can change the position of the light switch from "on" to "off," or vice versa, either by directly accessing the light switch or indirectly by accessing the slide bar.

3 Claims, 2 Drawing Sheets

EXTEND A SWITCH

I. CROSS-REFERENCE TO RELATED APPLICATIONS

This application claims the benefit of U.S. Provisional Application No. 60/556,943, filed Mar. 25, 2004.

II. BACKGROUND OF THE INVENTION

The present invention concerns that of a new and improved light switch and wall plate combination for use within a building or residence.

III. DESCRIPTION OF THE PRIOR ART

U.S. Pat. No. 5,374,797, issued to McMillan, discloses a switch cover comprised of an elongated wall panel with a sliding element and handle at the lower end to allow remote operation of a toggle switch by children or disabled people.

U.S. Pat. No. 4,454,401, issued to Powis Jr., discloses a sliding extension lever that is used to adapt a wall plate for standard toggle switch to allow for safe operation by children.

U.S. Pat. No. 4,295,026 issued to Williams, and U.S. Pat. No. 6,036,330 to Sanguedolce, discloses additional light switch extension devices.

IV. SUMMARY OF THE INVENTION

The present invention concerns that of a new and improved light switch and wall plate combination for use within a building or residence. The light switch is a standard light switch, but is connected to a slide bar that is placed in between a wall surface and an extended wall plate. The wall plate has two holes, one of which through the light switch can be accessed. The slide bar can be accessed through the other hole on the wall plate. An individual can change the position of the light switch from "on" to "off," or vice versa, either by directly accessing the light switch or indirectly by accessing the slide bar.

There has thus been outlined, rather broadly, the more important features of a light switch that the detailed description thereof that follows may be better understood and in order that the present contribution to the art may be better appreciated. There are, of course, additional features of the light switch that will be described hereinafter and which will form the subject matter of the claims appended hereto.

In this respect, before explaining at least one embodiment of the light switch in detail, it is to be understood that the light switch is not limited in its application to the details of construction and to the arrangements of the components set forth in the following description or illustrated in the drawings. The light switch is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present light switch. It is important, therefore, that the claims be regarded as including such equivalent constructions insofar as they do not depart from the spirit and scope of the present invention.

It is therefore an object of the present invention to provide a light switch which has all of the advantages of the prior art and none of the disadvantages.

It is another object of the present invention to provide a light switch which may be easily and efficiently manufactured and marketed.

It is another object of the present invention to provide a light switch which is of durable and reliable construction.

It is yet another object of the present invention to provide a light switch which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
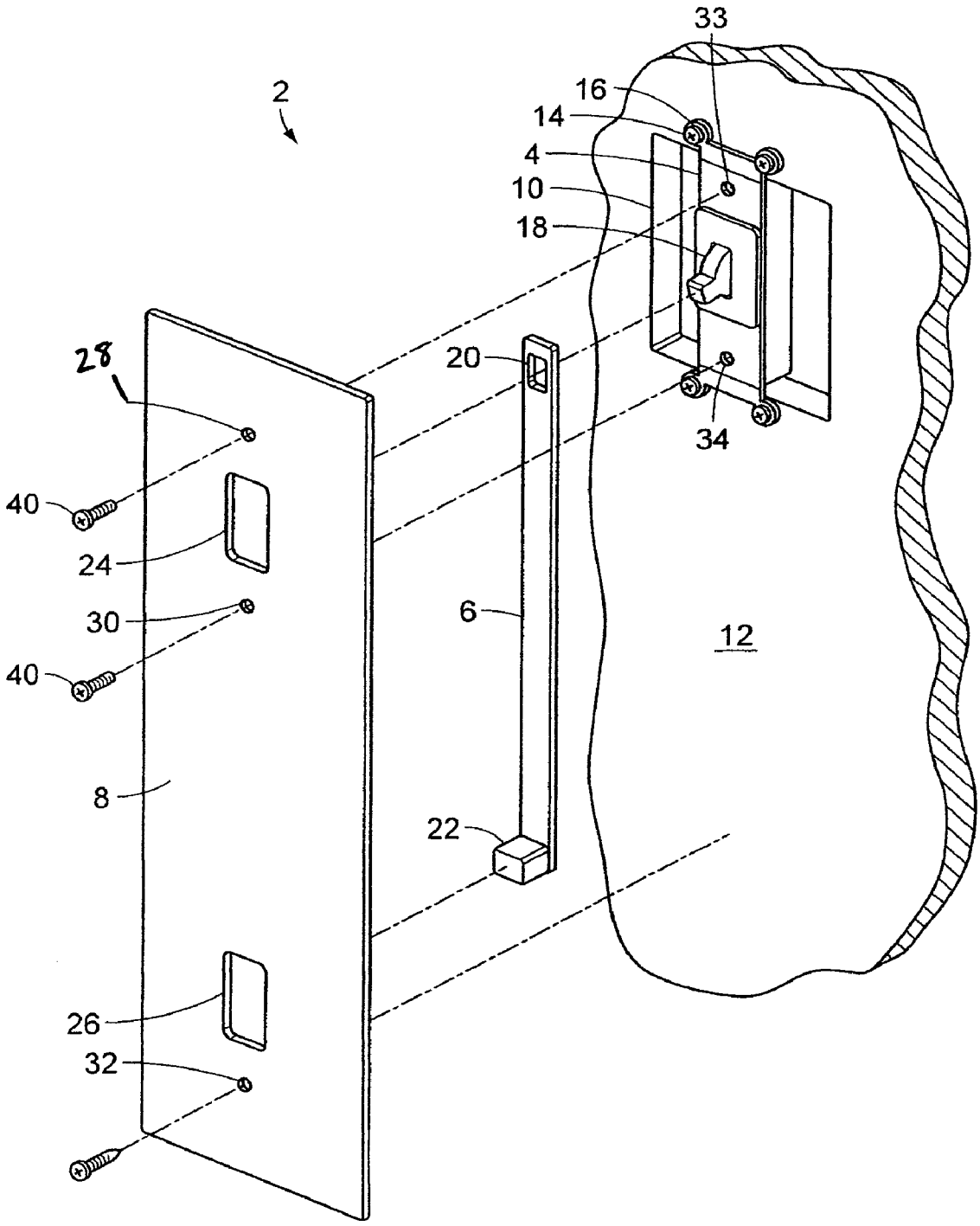
FIG. 1 shows a perspective view of the various parts of the present invention.

FIG. 1 shows a perspective view of the various parts of the present invention. Apparatus 2 comprises an installed light switch 4, a slide bar 6, and a modified wall plate 8 that works in conjunction with the slide bar 6.

Installed light switch 4 is shown installed in a typical junction box 10 that is placed within a wall surface 12. The junction box 10 is generally placed in this location prior to the wall surface 12 being installed, but it could also be placed in this location after the wall surface 12 has been put up. Light switch 4 is usually fixedly mounted within the junction box 10 by a quartet of screws 14 that are inserted through a quartet of holes 16 that are attached to the switch 4. Each screw 14 is inserted into the wall surface 12 after being inserted through a hole 16. Installed light switch 4 also has a two-position switch 18 that has an "on" position and an "off" position.

Slide bar 6 has two ends, a top end and a bottom end. The top end of the slide bar 6 has a square hole 20, which is designed to be placed over the two-position switch 18. The bottom end of the slide bar 6 has a button 22 attached to it, with the button 22 being fixedly attached.

Wall plate 8 has two ends, a top end and a bottom end. Wall plate 8 also has two holes comprising an upper hole 24 and a lower hole 26. Holes 24 and 26 are rectangular. Wall plate 8 also has a pair of set holes 28 and 30 adjacent to upper hole 24 and at least one set hole 32 to allow fixed placement of the wall plate 8 to the wall surface 12. Screws would be placed through set holes 28 and 30 in the wall plate 8 and set holes 33 and 34 in the light switch 4 to anchor the upper end of the wall plate 8, while a screw would be inserted through the set hole 32 to anchor the wall plate 8 to the wall surface 12.

Figure 2:
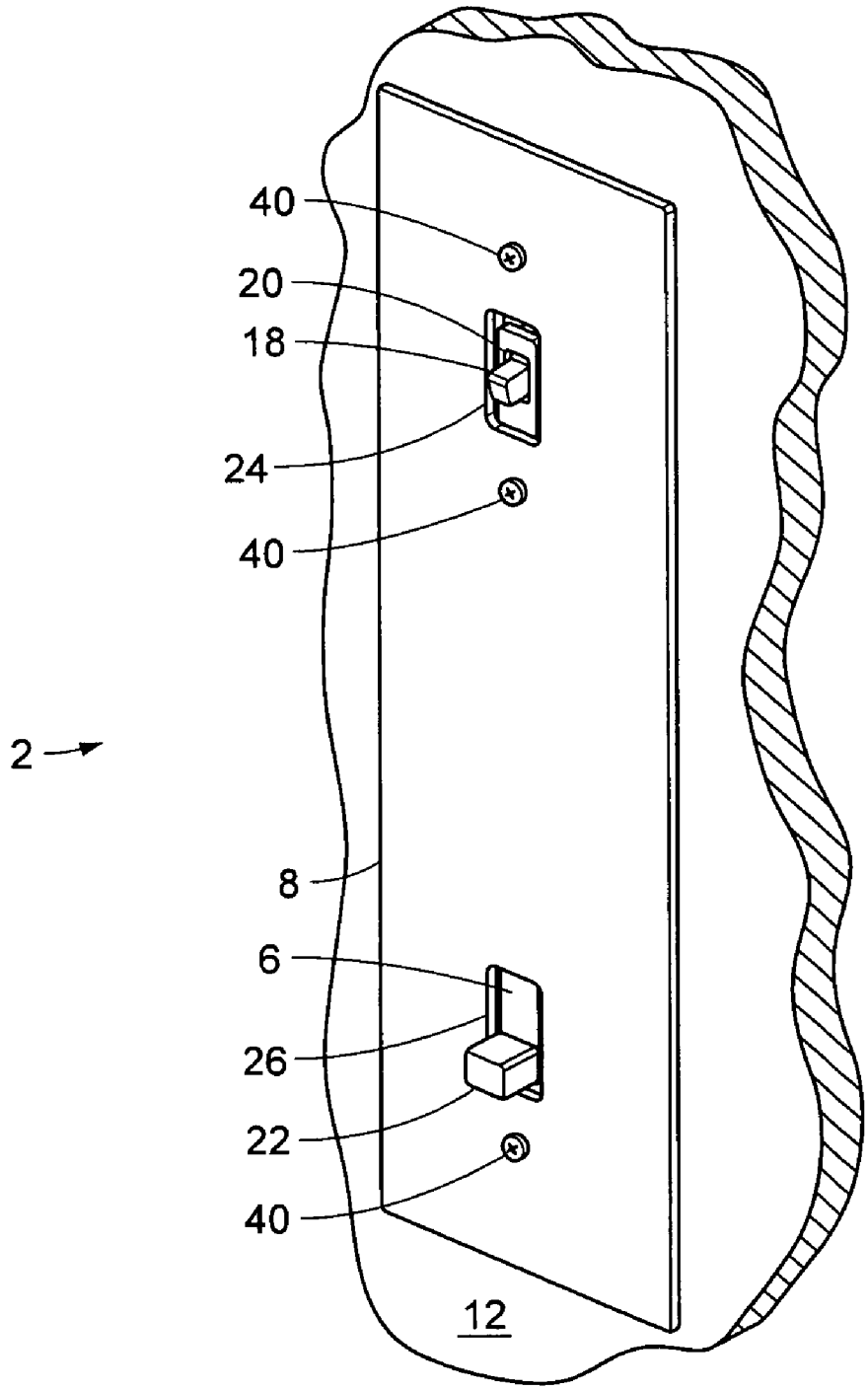
FIG. 2 shows a perspective view of the present invention as it would appear assembled and in use.

FIG. 2 shows a perspective view of the present invention as it would appear assembled and in use. The top end of the slide bar 6 has a square hole 20, which is placed over the two-position switch 18. After this occurs, the wall plate 8 is placed over the slide bar 6 such that the upper hole 24 is placed over the two-position switch 18 and the square hole 20 and the lower hole 24 on the wall plate 8 is placed over the button 22 on the lower end of the slide bar 6.

After this occurs, screws 40 are used to attach holes 28 and 30 on the wall plate 8 to holes 33 and 34, respectively, in the light switch 4. Then, a screw 40 is inserted through hole 32 on the wall plate 8 and to attach the lower end of the wall plate 8 to the wall surface 12.

Once properly installed, an individual can change the position of the two-position switch 18 in two different ways. First, the individual could move it up or down by merely grasping the two-position switch 18 and moving it accordingly. Also, an individual could grasp button 22 and move it up or down, as needed. Since button 22 is fixedly connected to the slide bar 6, moving the button 22 up or down will move the two-position switch 18 up or down, respectively.

What I claim as my invention is:

1. A wall switch apparatus comprising:

a wall surface;

a junction box installed into the wall surface;

a light switch mounted within the junction box, the light switch also including a two-position switch, the two-position switch having two positions comprising an "on" position and an "off" position;

means for mounting the light switch within the junction box;

a uniformly straight slide bar having a top end and a bottom end;

a square hole located at the top end of the slide bar, the square hole placed over the two-position switch;

a button located at the bottom end of the slide bar, the button extending ninety (90°) degrees directly from the bottom end of the slide bar;

a wall plate having a top end and a bottom end;

a pair of holes located on the wall plate comprising an upper hole and a lower hole, each of the holes being equally rectangular such that a length of each hole is greater than a width of each hole;

means for mounting the wall plate to the wall surface;

wherein the wall plate is placed over the slide bar so that the button located on the bottom end of the slide bar is sticking out of the lower hole of the wall plate, and further wherein the two-position switch of the light switch is sticking out of the upper hole of the wall plate, and further wherein grasping the button on the slide bar will cause the light switch to move up or down as the button is moved up or down, respectively.

2. A wall switch apparatus according to claim 1 where the means for mounting the wall plate to the wall surface further comprises:

a plurality of set holes located on the wall plate;

a plurality of screws;

wherein one screw is inserted through each set hole on the wall plate, further wherein each screw inserted through each set hole on the wall plate is inserted into the wall surface.

3. A wall switch apparatus according to claim 2 wherein the means for mounting the light switch within the junction box further comprises:

a quartet of holes attached to the light switch;

a quartet of screws;

wherein one screw is inserted through each hole of the quartet of holes, and further wherein each screw is inserted into the wall surface after it has been inserted through a hole of the quartet of holes.

* * * * *